United States Patent [19]

Gregg et al.

[11] 4,094,392

[45] June 13, 1978

[54] LUGGAGE LATCH MECHANISM

[75] Inventors: James S. Gregg, Denver; William J. Reynolds, Arvada, both of Colo.

[73] Assignee: Samsonite Corporation, Denver, Colo.

[21] Appl. No.: 773,375

[22] Filed: Mar. 1, 1977

[51] Int. Cl.[2] ..... A45C 13/10
[52] U.S. Cl. ..... 190/41 R; 292/153
[58] Field of Search ..... 190/41 R; 292/153; 206/1.5; 70/70, 71

[56] References Cited

U.S. PATENT DOCUMENTS

| | | | |
|---|---|---|---|
| 3,245,236 | 4/1966 | Atkinson | 70/71 |
| 3,828,899 | 8/1974 | Scott | 190/41 R |

*Primary Examiner*—Donald F. Norton
*Attorney, Agent, or Firm*—George J. Netter

[57] ABSTRACT

A gravity positioned detent is moved into obstructing relation to the end of a slidable latch member when the luggage case is wrong-side-up, preventing operation of the latch mechanism and opening of the case. When oriented right-side-up, the detent is moved out of the way, allowing full operation of the latch mechanism and opening of the case.

4 Claims, 7 Drawing Figures

LUGGAGE LATCH MECHANISM

The present invention relates generally to a luggage latch mechanism, and, more particularly, to a gravity operated latch mechanism that is automatically locked when the luggage is inverted and operable for other orientations of the luggage.

BACKGROUND OF THE INVENTION

In the packing of luggage, valises, attache cases or the like, the materials are placed therein in such an arrangement that there is a "top" and "bottom", and it is desirable that when the luggage is opened the "top" will be in the desired position. In this manner, retrieval of the contained materials is aided with a minimum of damage and confusion. The wrong-side up problem is frequently found with valises or attache cases which are typically constructed of symmetrical halves, making it difficult to tell the top from the bottom. An excellent means for solving this problem is that disclosed in U.S. Pat. No. 3,828,899, ORIENTATION SENSITIVE LUGGAGE LATCH by Charles J. Scott. As described in that patent, an L-shaped member is pivotal under the action of gravity to cause a hook-end to lock the luggage case latching mechanism and prevent its opening when the case is in an upside down condition. On the other hand, when properly oriented, the luggage case latch mechanism may be operated as in conventional luggage cases, since gravity moves the hook-end of the L-shaped member into an out-of-the-way position.

SUMMARY OF THE INVENTION

In accordance with the practice of the present invention, a gravity positioned detent is incorporated into and coacts with the luggage latch mechanism. More particularly, the gravity positioned detent is moved into obstructing relation to the end of a slidable latch member when the case is wrong-side-up, thereby preventing operation of the latch mechanism and opening of the case. When oriented "right side up", the detent is moved into an out-of-the-way position, allowing full operation of the latch mechanism and opening of the case.

DESCRIPTION OF A PREFERRED EMBODIMENT

Figure 1:
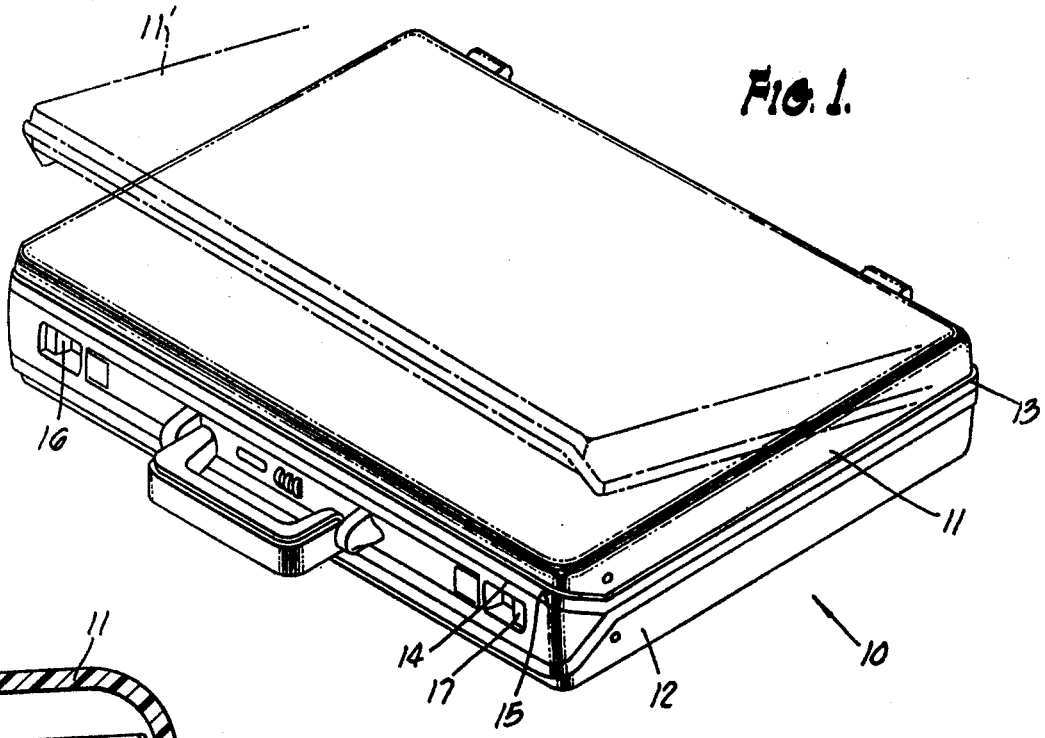
FIG. 1 depicts a luggage case oriented with the right side up.

Turning now to the drawing and particularly FIG. 1, a luggage case of the kind frequently referred to as an attache case, is enumerated generally as at 10. Although the invention to be described herein can be advantageous for use with any kind of luggage case, it will find its most common utility with an attache case or such a luggage case in which business papers are carried and are preferred to be maintained in a given orientation.

As shown in FIG. 1, the luggage case 10 includes a pair of substantially identically appearing case sections 11 and 12, pivotally connected together along a common edge 13. In the usual situation, a pair of the case section edges 14 and 15 of the respective sections 11 and 12 are selectively secured together by a latch mechanism to be described later herein. Actuation of the finger operated members 16 and 17 releases the latch mechanism, allowing the case sections to be separated, as shown by the dashed line depiction of section 11. That is, to open the luggage case shown in FIG. 1 when it is closed and fully latched, each of the members 16 and 17 must be moved in a direction toward the closer end wall before the case sections may be separated from one another. Moreover, as will be described, the subject invention only permits the latch mechanism to be opened when the luggage case either has section 11 in the upper position as in FIG. 1, with part 12 thereunder, or with both of the sections 11 and 12 having their major planes in an upright position. Any other orientation, such as with the case part 12 in the upper position, will cause the latch mechanism to be locked and the case cannot be opened.

Figure 2:
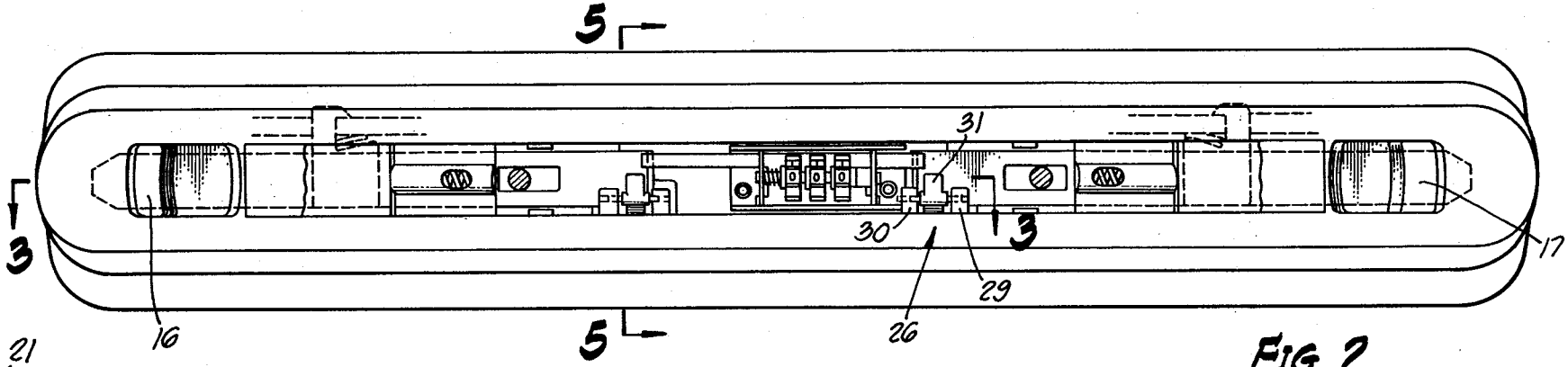
FIG. 2 is a front elevational, partially sectional view of the luggage case of FIG. 1.

Turning now to FIG. 2, it is seen that the luggage case includes two sets of latching mechanisms, one at the right and one at the left, which are individually operable by manipulation of the members 16 and 17, respectively. However, since the construction is the same for each of the latch mechanisms, except that the parts have a mirror image relationship to corresponding parts in the other set, only the mechanism associated with the actuator 17 will be described in detail.

Figure 5:
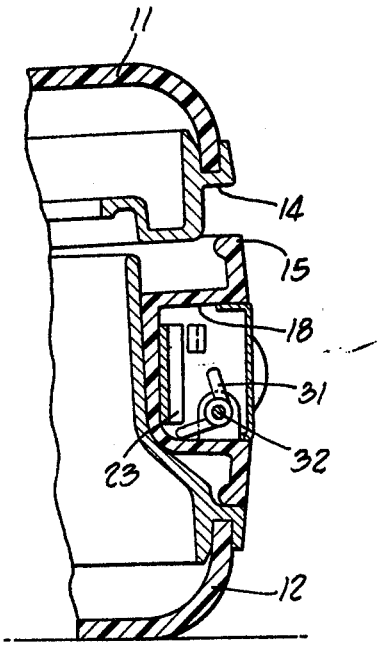
FIG. 5 is an end elevational sectional view taken along the line 5—5 of FIG. 2, showing the case right-side-up, permitting unlatching.
Figure 6:
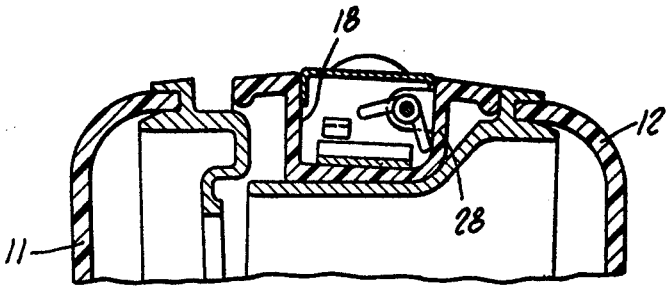
FIG. 6 is a view similar to FIG. 5, with the case in vertical position and still in condition permitting opening.
Figure 3:
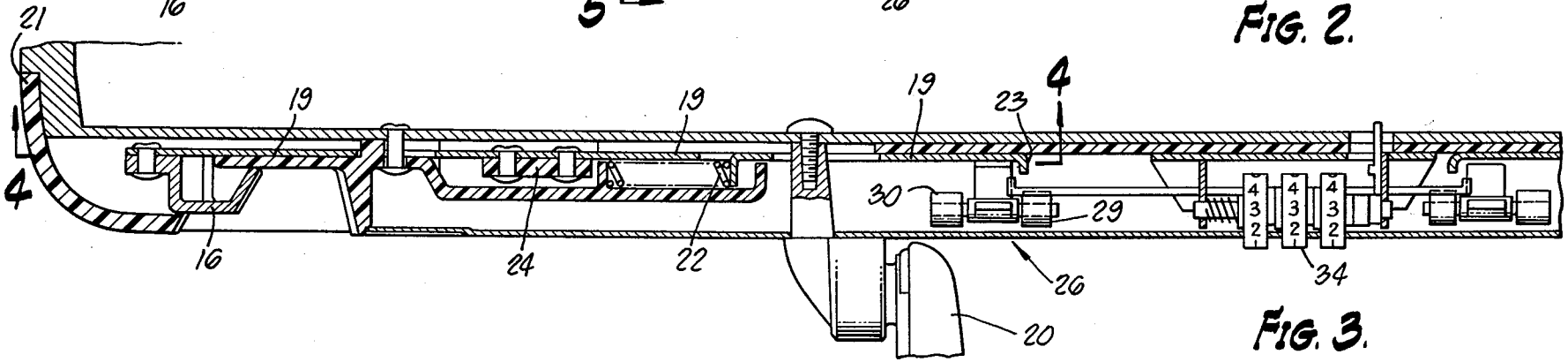
FIG. 3 is a top plan, sectional view taken along the line 3—3 of FIG. 2.
Figure 4:
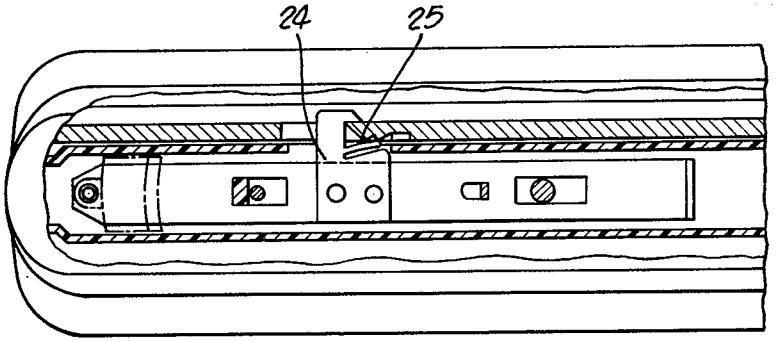
FIG. 4 is a view similar to FIG. 3, partially fragmentary, showing the case parts in latched closed position.

As can be best seen by reference to both FIGS. 3 and 5, the top edge wall of case section 12 includes a channel 18 formed therein which extends throughout the entire length of the luggage. A generally flat, sheetlike drive plate 19 is received within the channel 18 and extends from a point just inwardly of one arm of the case handle 20 to an outer limit slightly inwardly of the case section end wall 21. The outer terminus of the drive plate has the finger operated actuator member 16 affixed, the latter member constructed with a surface against which finger pressure can be applied (arrow in FIG. 3) to move the drive plate toward the end wall 21. A compression coil spring 22 coacts with the drive plate and channel walls to resiliently urge the drive plate toward the center of the case section top wall or away from the end wall 21. The drive plate inner end is shaped to form an upstanding portion 23 extending away from the channel bottom wall generally transversely of the direction of translatory motion of the drive plate along the channel. In a way that will be more particularly described later, the upstanding member serves as a stop or member that is engaged to prevent drive plate movement. As shown there, a hooklike clasp 24 is secured to the drive plate just outwardly of the coil spring 22 and substantially inwardly of actuator 16. The clasp extends transversely from the drive plate toward the case section 11, and when the two case sections are closed on one another, the clasp is received within an opening in section 11 releasably engaging adjacent wall portions. Movement of the drive plate toward the closer case section end wall releases the clasp 24 from engagement with case section 11 and the inherent spring qualities of the clasp member 25 causes the two sections to separate automatically (FIG. 4).

Simultaneous reference to FIGS. 2 and 3 should now be made for the ensuing description of the gravity operated latch locking mechanism enumerated generally as at 26. A bifurcated support or stanchion is secured to a side wall 28 of the channel 18 and includes a pair of posts 29 and 30 spaced from one another longitudinally along the channel.

A detent 31, having a pair of equilength arms extending at right angles to one another (FIGS. 4–7) is rotatably mounted to the stanchion posts 29 and 30 via a pin 32. More particularly, the pin 32 passes through the opening at the point of juncture of the detent arms and extends from both sides generally normally to the plane formed by the arms. Preferably, the pin is secured to the detent and pivotally mounted to the stanchion posts.

In operation, assuming the luggage case to be resting on a generally horizontal surface with case section 12 down as shown in FIGS. 1 and 5, the case is in the "right-side-up" position and the detent arms are in non-obstructing relation to the drive plate stop 23, allowing full releasing actuation of the case latch mechanism. Specifically, one of the arms bears against the channel side wall, which leaves sufficient space between the detent arms for the stop 23 to pass.

Resting the luggage case on its lower or bottom surface (FIG. 6) with both case sections extending vertically upwardly still permits the case to be opened, since although the detent arm may move away from contact with the channel wall a slight amount, it is not enough to cause engagement with the drive plate stop 23 when release actuation is attempted.

Figure 7:
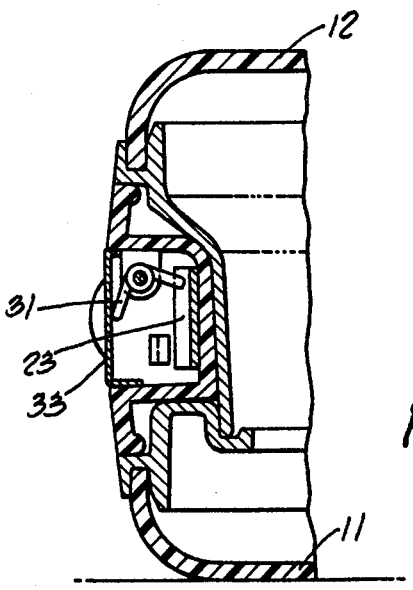
FIG. 7 is a still further view similar to FIG. 5 with the case upside-down and locked by the present invention.

Inverting the luggage case to the "upside-down" position shown in FIG. 7 with case section 11 down, causes the detent arm which had previously been in contact with the channel side wall to fall away from that wall under the influence of gravity into the path of stop 23 when the drive plate is actuated in attempted release. Now, when actuator member 16 is pressed, the detent arm engages stop 23 preventing the drive plate from moving enough to release the two case sections. It is important to note that at this time the other detent arm contacts a cover plate 33 arranged over the channel and in that way prevents the detent from rotating too far and insures that the detent is held in locking mode.

Although not an essential part of the present invention, it is contemplated that the attache case may contain other conventional features such as having a combination lock 34 which are cooperatively interconnected with the latching mechanism. A handle 20 may also be connected to the case top wall in any suitable manner or may be mounted directly into the channel by a suitable fitting as shown in FIG. 3.

We claim:

1. A latch mechanism for releasably securing first and second luggage case sections to one another, comprising:

means carried by the first case section including walls defining an opening;

a drive plate having a hooklike clasp mounted on the second case section, said clasp being located for receipt within the opening in the first case section when the two sections are closed on one another and said drive plate and clasp being selectively movable with respect to said second case section from a first position of locking engagement of the clasp and walls defining said opening to a second position of disengagement of said clasp and opening defining walls;

said drive plate including a stop member extending transversely of the direction of movement of said plate; and a gravity operated member pivotally mounted to said second case section and rotatable under the action of gravity from a position engaging the stop member of the drive plate with respect to the first case section preventing movement of the drive plate in a direction to release the latch mechanism to a position lying without the drive plate path of movement.

2. In a luggage case having first and second case sections closable upon each other, the first case section including a latch mechanism for releasably joining the case sections together when they are closed, said latch mechanism being released by moveing a drive plate along a first direction, comprising:

a detent mounted to said first case section to rotate under the influence of gravity alone in a plane transversely of the direction of movement of said drive plate from a first position preventing said drive plate movement to a second position out of the path of movement of said drive plate.

3. In a luggage case as in claim 2, in which the drive plate and detent are enclosed within a closed channel carried by the first case section, walls defining said channel forming limits for rotative movement of the detent.

4. In a luggage case as in claim 2, in which the detent is L-shaped and mounted for rotation about an axis located at the common point of detent legs.

* * * * *